US005930927A

United States Patent [19]

Griffin et al.

[11] Patent Number: 5,930,927

[45] Date of Patent: Aug. 3, 1999

[54] APPARATUS FOR CHANGEABLE DISPLAY FOR LOUVERED SHUTTER

[76] Inventors: G. Wesley Griffin; Sheila L. Griffin, both of 62 Pond St., South Yarmouth, Mass. 02664

[21] Appl. No.: 08/912,734

[22] Filed: Aug. 18, 1997

[51] Int. Cl.[6] ..... G09F 7/04

[52] U.S. Cl. ..... 40/621; 40/617; 40/600; 160/10

[58] Field of Search ..... 40/600, 621, 617; 49/74.1; 160/10; 248/222.51, 311.2, 475.1, 489, 692; 52/473

[56] References Cited

U.S. PATENT DOCUMENTS

| | | | |
|---|---|---|---|
| 3,670,438 | 6/1972 | Carroll et al. | 40/600 |
| 3,965,599 | 6/1976 | Ebner . | |
| 3,987,567 | 10/1976 | Fritts . | |
| 4,258,493 | 3/1981 | Kettlestrings et al. | 40/600 |
| 4,583,312 | 4/1986 | King et al. | 40/621 |
| 4,605,292 | 8/1986 | McIntosh . | |
| 5,050,834 | 9/1991 | Tardiff | 248/467 |
| 5,167,087 | 12/1992 | Plumly | 40/600 |
| 5,379,976 | 1/1995 | DeGirolamo | 248/222.51 X |
| 5,384,999 | 1/1995 | Roche et al. | 40/600 X |
| 5,392,577 | 2/1995 | D'Onofrio, Jr. et al. | 52/473 |
| 5,697,587 | 12/1997 | Israel | 248/311.2 |

FOREIGN PATENT DOCUMENTS

| | | | |
|---|---|---|---|
| 2610437 | 8/1988 | France | 40/600 |

*Primary Examiner*—Joanne Silbermann
*Attorney, Agent, or Firm*—Thomas A. Kahrl, Esq.

[57] ABSTRACT

A display arrangement for sheet-type materials including a fastening system having a malleable metal hook set which supports an adhesive/magnetic sandwich for suspending a metal backing plate that magnetically retains an image affixed to a display sheet, wherein display sheets are applied onto conventional shutters of doors and windows by a metallic hanger strip having a bent end hook set for bending into engagement with the lower edges of a louver, an adhesive layer, a magnetic sheet adhered to the adhesive surface on both front and rear of the metallic sheet, a second metal sheet which attaches magnetically to the magnetic sheet; and a display sheet having a magnetic backing layer which attaches to the galvanized metal sheet.

3 Claims, 5 Drawing Sheets

APPARATUS FOR CHANGEABLE DISPLAY FOR LOUVERED SHUTTER

BACKGROUND OF THE INVENTION

The present invention relates to changeable display arrangements for sheet type materials. More particularly, the invention is a device which includes the inventive combination of a fastening system having a malleable metal hook set which carries an adhesive/magnetic sandwich for suspending a metal backing plate that magnetically retains an image affixed to a display sheet. In the specific arrangement of the invention, the display sheets are applied onto conventional shutters, typically used with doors and windows.

1. Field of the Invention

The present invention relates to display arrangements for sheet type material. Said display arrangements comprise a novel fastening apparatus having a malleable metal hook device and an adhesive/magnetic sandwich member for suspending a metal mount on a louvered shutter. The fastener system magnetically retains an image affixed to a magnetic sheet for the purpose of displaying said image.

2. Background Art

There have been prior attempts in the prior art to fasten display device to a surface by means of magnetic material. For example, KETTLESTRINGS ET AL U.S. Pat. No. 4,258,493 shows an adhesive layer 20, FIG. 5 attaching a pair of magnetic strips 24, 25 to a glass surface 14.

MCINTOSH, U.S. Pat. No. 4,605,292 discloses a mirror with a sheet-like body having a strip of magnetic material for magnetically bonding to a magnetically attractive surface an adhesive strip for bonding to a non-magnetically attractive support surface.

However, a review of the above patents indicates that the prior art has not located showings of the subject fastening system having a magnetic/adhesive sandwich which employs a display sheet having a front and a back, the front having changeable image means and the back having magnetic bonding means configured to successively magnetically bond to a metallic sheet and to a sandwich member. The present invention employs the advantageous characteristics of a magnetic/ladhesive sandwich which uses a metallic strip to attach a magnetic display sheet to a louvered panel. By employing a magnetically attractive, generally vertical surface, the present invention permits easy change of the magnetic display sheet for changing the decorative effect on a vertical member such as a louvered shutter.

The prior art does not present such an efficient and effective apparatus of arranging graphic display on a shutter, particularly on a pair of louvered shutters.

SUMMARY OF THE INVENTION

The present invention relates to apparatus for changeable display for a louvered shutter whereby you can easily install and change graphic art, symbols, or other images on window and door shutters inside or outside a house or other building. In particular the present invention is directed to a display arrangement for sheet-type materials including a fastening system having a malleable metal hook set which supports an adhesive/lmagnetic sandwich for suspending a metal backing plate in a generally vertical plane that magnetically retains an image affixed to a display sheet.

In the present invention, display sheets are applied onto conventional shutters of doors and windows by a sandwich member having a metallic hanger strip having a bent end hook set for bending into engagement with the lower edges of a louver. In particular the display sheet includes a front and a back, the front having changeable image means and the back having magnetic bonding means configured to successively magnetically bond to a metallic sheet and to a sandwich member. As is shown in FIG. 4, a metal backing plate is configured to magnetically retain the image affixed to said display sheet arranged to be hung on a frame member by said sandwich member.

The sandwich member comprises an adhesive magnetic sandwich having a first side for suspending said metal backing plate and a second side for suspending support apparatus for attaching said sandwich member to the frame member, comprising in combination a malleable metal hook set including a hanger strip constructed of a length of metallic flashing and having a bent hook and a set of notches along each side of said strip. The strip also includes a first adhesive layer adhered to a first side of said hanger strip for presenting an available adhesive surface to adhesively bond to said frame; and a second adhesive layer adhered to a second side of said hanger strip for presenting an available adhesive surface to adhesively bond to said backing plate. When the first side of said magnetic/adhesive sandwich member is connected to the metallic sheet member and the second side is connected to the louvered surface for attaching the display sheet to said frame member permitting the image means to be selectively changed.

In the present invention, said hanger consists of a plurality of sets of bent hook devices, each set connected adhesively to an attachment strip, each strip having a hook at the top and having notches spaced every 4 or 5 louvers to be bent under a louver. Bending typically is performed by employing a bending tool, typically a screw driver and grasping one of the louvers on the left and right edges every few inches to hold in place the metallic sheet, typically a sheet of aluminum material. Each strip employs a two inch double sided waterproof tape adhesive used on front and back surfaces (2 per shutter), having a first side for adhesively bonding to a set of bent hook devices and a second side for adhesively bonding to said magnetically attractive sheet. In the present invention, a magnetically attractive sure comprises a sheet of magnetic metallic material, typically consisting of flashing, having hanger apparatus for cooperating with the louvers of the shutter. Said flashing is effective to provide for releaseably fastening a display sheet, typically certain graphic illustrations comprising flexible magnetic sheets, typically magnetic sign material.

Once the hanger is attached to the shutter you next attach the sheet of galvanized sheet metal to the adhesive strips. Because some louvers vary in size and space, some sheets will be held by having "U" shape tabs formed into the metal.

The decorative graphic work which is typically generated by a computerized copy machine, is affixed to a transfer sheet and heat pressed into a sheet of magnetic sign material cut to fit inside shutter frame, or printed directly on to a magnetic sheet. Said art work employs an image which can come from a photo, slide, or print or be generated from computer software, and can be changed from one image to another in seconds by peeling off one magnetic sheet and replacing it with another.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

BRIEF DESCRIPTION OF THE DRAWINGS

The accompanying drawings, which are incorporated into and form a part of the specification, illustrate several embodiments of the present invention and together with the description serve to explain the principals of the invention. The drawings are only for the purpose of illustrating a preferred embodiment of the invention and are not construed as limiting the invention.

DETAILED DESCRIPTION OF THE PREFERRED EMBODIMENT

Figure 1:
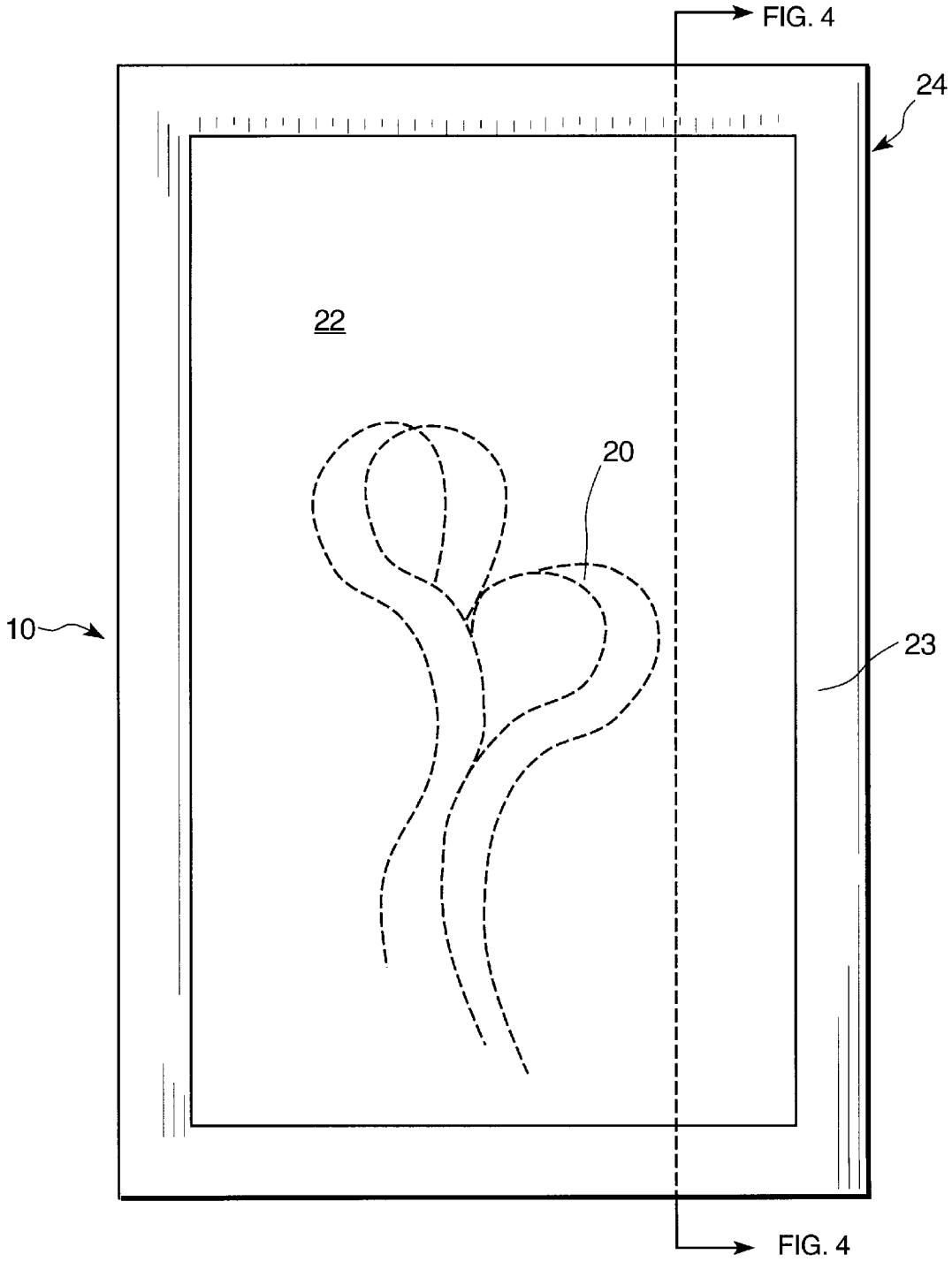
FIG. 1 is a plan view of the Changeable Display for Louvered Shutter Apparatus of the present invention from the front, showing an image attached to a shutter.
Figure 2:
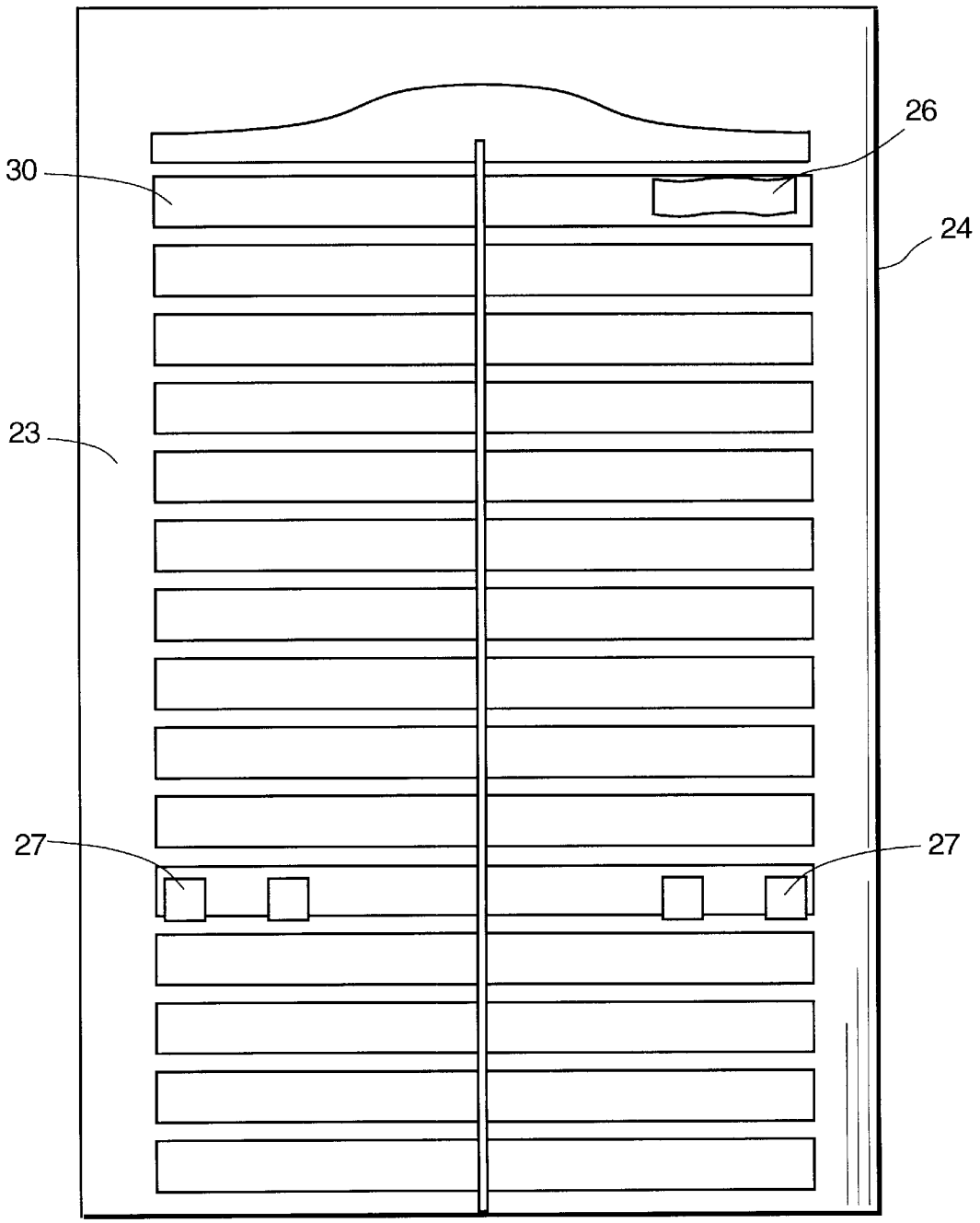
FIG. 2 is a plan view of the Changeable Display of FIG. 1, from the rear, showing fasteners attached to a louvered shutter.
Figure 3:
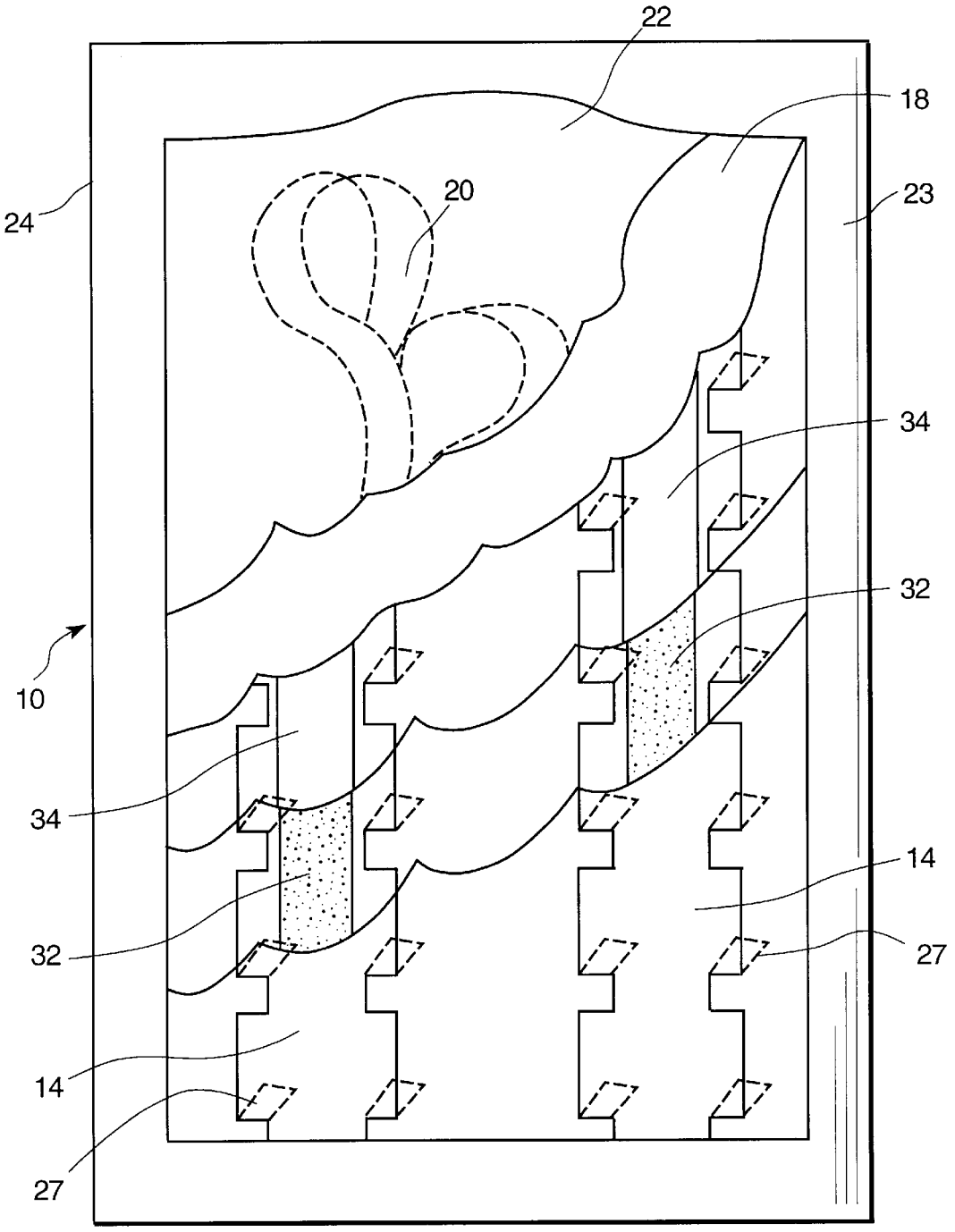
FIG. 3 is a plan view of the Changeable Display of FIG. 1, showing multiple layers, including the display sheet, a galvanized metal sheet, an adhesive/magnetic snadwich assembly, and a malleable sheet of flashing with cut tabs attached to a louvered shutter.

Referring to FIGS. 1–4, the present invention is directed to a changeable display arrangement 10 for sheet type materials, including a fastening system 12 having at least one malleable sheet of flashing with cut tabs to form hook sets 14 which carries an adhesive/magnetic sandwich assembly 16 for suspending a galvanized metal sheet 18 that magnetically retains a display sheet 22 having an image 20 affixed thereto.

In the preferred embodiment of the present invention, the display sheet 22 is applied onto a conventional shutter 24 having frame 23. The fastening system 12 includes a malleable sheet of flashing with cut tabs to form hook sets 14 comprising a series of bent hook ends 26 and cut tabs 27. In the specific arrangement of the invention, the display sheet 22 is applied to said shutter 24 by a sheet of flashing 14 made of a length of aluminum flashing and having a bent hook ends 26 to be bent over a louver 30 near the top of the conventional shutter 24. Said strip 14 also includes a set of cut tabs 27 arranged along each long side of said strip for selectively bending one or more of said cut tabs 27 into engagement with a lower edge 25 of a louver element 30 of shutter 24.

Figure 4:
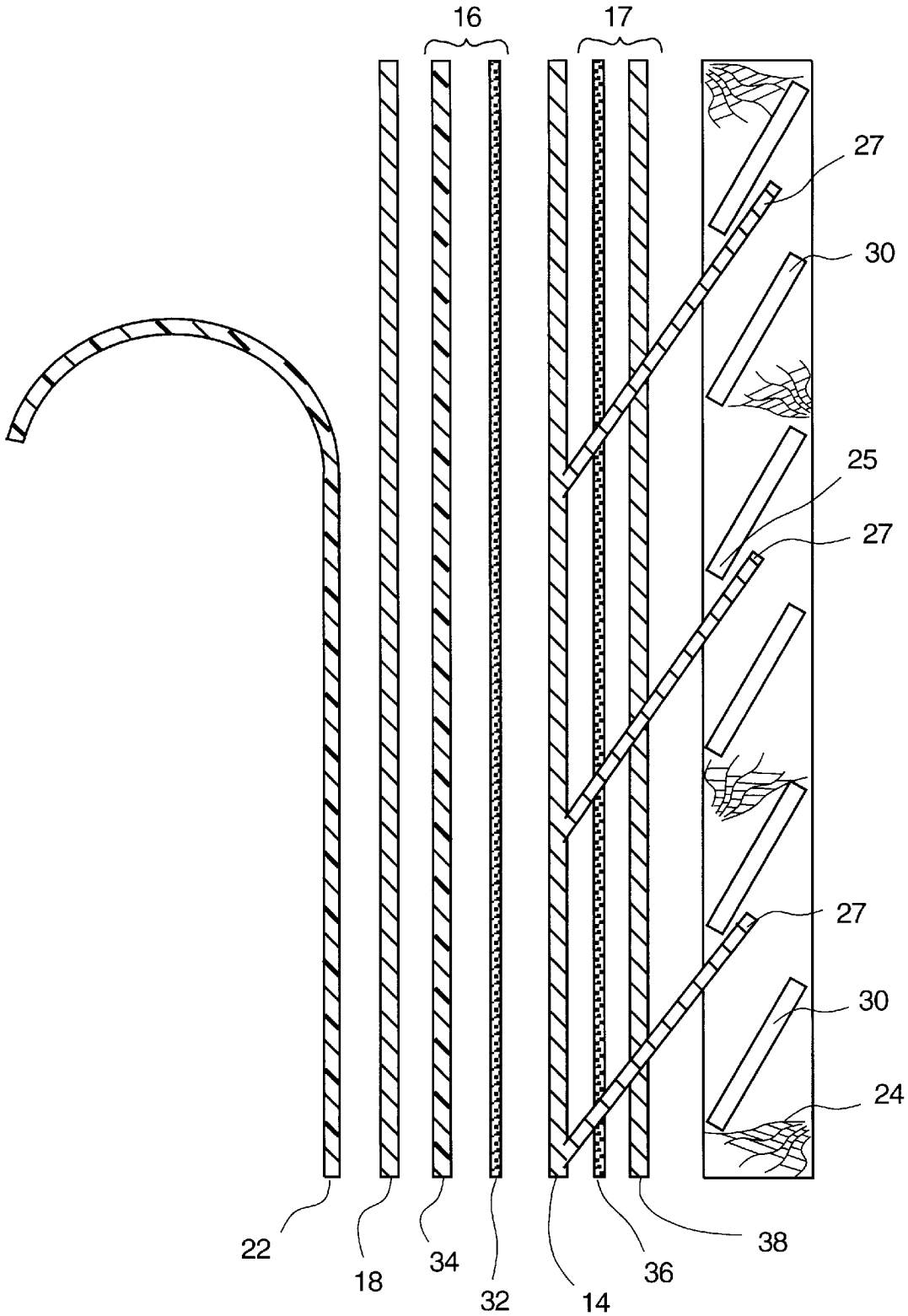
FIG. 4 is an exploded side view of Changeable Display of FIG. 1 shown in section along lines 4—4.

As is shown in FIG. 4 an adhesive bonding layer 32 is adhered to the malleable sheet of flashing with cut tabs 14 and presents an available adhesive surface for engaging a strip of magnetic stock 34, which then engages a sheet of galvanized sheet metal 18. A second adhesive bonding surface 36 on the rear of the malleable sheet of flashing with cut tabs 14 and a second strip of magnetic stock 38 complete the sandwich.

As is shown in FIG. 4 a metal sheet 18, constructed of galvanized metal is magnetically bonded to sandwich member 16. A display sheet 22 having a magnetic backing layer bonds to the galvanized metal sheet of sheet 18. The sandwich member 16 is bonded adhesively to a malleable sheet of flashing with cut tabs 14. On the reverse side of the malleable sheet 14, a second adhesive/magnetic sandwich assembly 17, consisting of a second adhesive bonding layer 36 and a second strip of magnetic stock 38, is adhesively bonded. The bent hook ends 26 and cut tabs 27 on the malleable sheet 14 are employed to engage the louver elements 30 of a conventional shutter 24.

Figure 5:
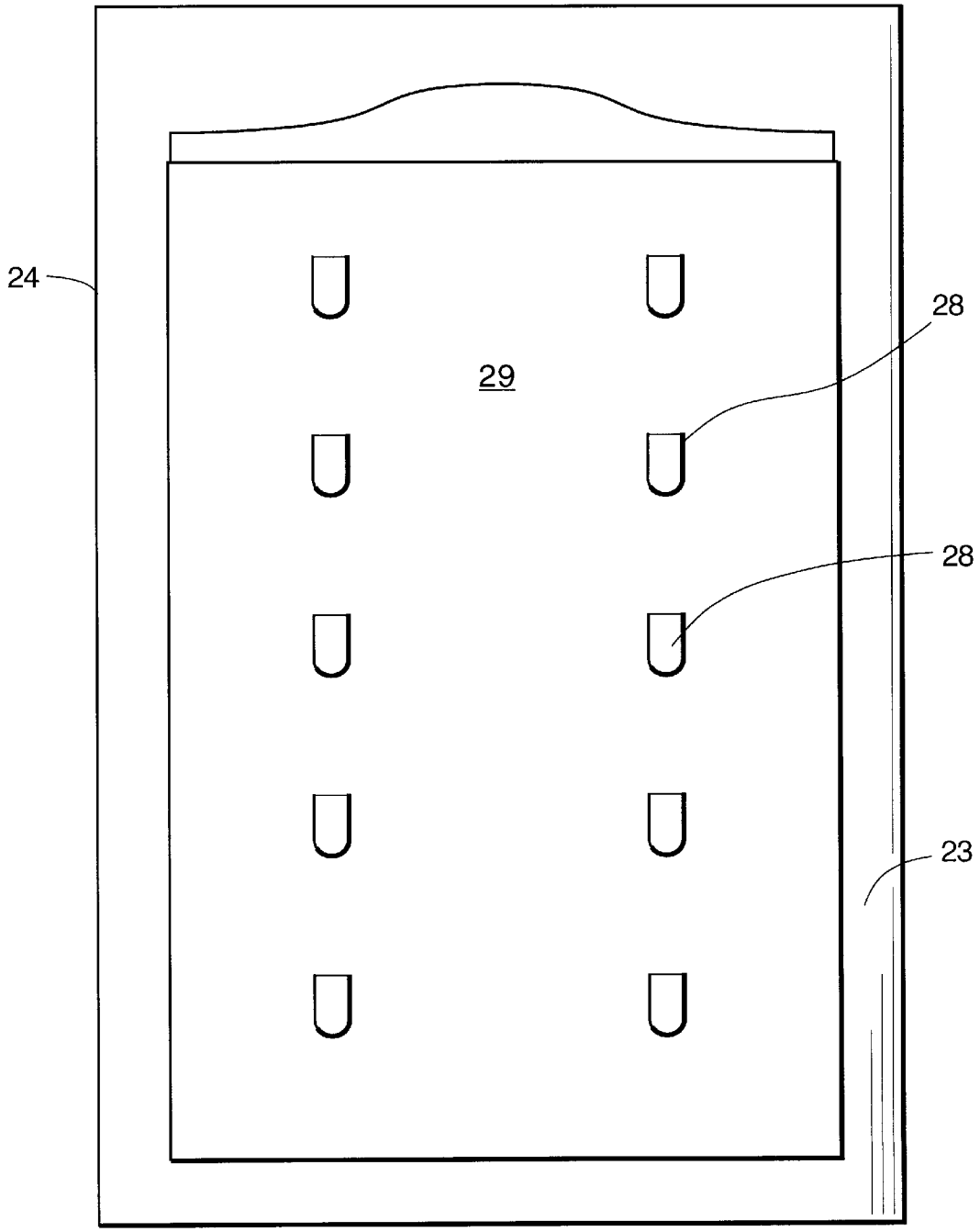
FIG. 5 is a plan view of an alternate embodiment showing a galvanized metal sheet with 30 notches.

FIG. 5 shows an alternate embodiment consisting of a galvanized metal sheet 29 having notches 28 spaced every 4 or 5 louvers. Bending said hooks is accomplished by employing a screwdriver and by grasping the top edge of one of the louver elements 30 every few inches to hold in place the galvanized metal sheet 29. Once the galvanized metal sheet 29 is attached to the shutter, an image 20 attached to a magnetic display sheet 22 can be adhered to the sheet magnetically and can easlily be peeled off and replaced by another image adhered to another magnetic display sheet.

We claim:

1. A display arrangement comprising;

a) a frame member having a louvered panel, b) a display sheet having an image on the front and magnetic bonding means on the back, c) a metallic backing plate retaining the display sheet, d) a sandwich member which supports on one side a fastening means including a malleable metal hook set having a hanger strip, a bent hook and a set of notches for attaching to the frame, and also having an adhesive layer on one side of the hanger strip and a second adhesive layer on the other side to bond on the one side with the backing plate and to support on the other side the backing plate, and wherein the one side also provides means for attaching to the louvered surface.

2. The display arrangement of claim 1 wherein the image comprises art work generated by a computer generated copy machine and printed directly on the magnetic bonding means and placed on a transfer sheet and heat pressed into a sheet or magnetic sign cut to fit inside shutter frame whereby an image can be selected from a photo, slide, or print or be generated from computer software, and can be changed from one image to another in seconds by peeling off one magnetic sheet and replacing it with another.

3. A display arrangement for sheet-type materials comprising;

1) a malleable metal hook set which supports an 2) adhesive/magnetic sandwich for suspending 3) a metal backing plate that magnetically retains 4) an image affixed to a display sheet wherein said display sheets are applied selectively onto shutters of doors, or alternatively windows, by means of:

a) a hanger strip made of a length of aluminum sheet metal and having a bent end hook and set of notches along each long side of the strip for bending into engagement with the lower edges of a louver;

b) an adhesive layer adhered to the strip and presenting an available adhesive surface;

c) a magnetic sheet adhered to the adhesive surface on both front and rear of the hanger strip;

d) a galvanized metal sheet which attaches magnetically to the magnetic sheet with said sheets being held by having "U" shape tabs formed into the metal.

e) a display sheet having a magnetic bonding means which attaches to the galvanized metal sheet.

* * * * *